United States Patent [19]

Futamura et al.

[11] Patent Number: 4,641,570

[45] Date of Patent: Feb. 10, 1987

[54] SWASH PLATE TYPE COMPRESSOR HAVING A CENTER CAVITY IN SURFACE OF PISTON SHOE

[75] Inventors: Kenichiro Futamura; Keiichiro Ohtsu, both of Toyota; Tatsuhiko Fukuoka, Aichi; Kenji Takenaka; Yoshio Itakura, both of Kariya; Hiroshi Koga, Chiryu, all of Japan

[73] Assignees: Taiho Kogyo Kabushiki Kaisha, Toyota; Kabushiki Kaisha Toyoda Jidoshokki Seisakusho, Kariya, both of Japan

[21] Appl. No.: 858,580

[22] Filed: Apr. 29, 1986

Related U.S. Application Data

[63] Continuation of Ser. No. 630,587, Jul. 10, 1984, abandoned.

[30] Foreign Application Priority Data

Jul. 20, 1983 [JP] Japan ..... 58-132106

[51] Int. Cl.[4] ..... F01B 3/00; F04B 1/18

[52] U.S. Cl. ..... 92/71; 417/269; 92/153; 74/60

[58] Field of Search ..... 417/269, 222; 92/71, 92/12.2, 153; 91/488; 74/60; 308/DIG. 8

[56] References Cited

U.S. PATENT DOCUMENTS

| | | | |
|---|---|---|---|
| 2,721,519 | 10/1955 | Henrichsen | 91/472 |
| 3,395,948 | 8/1968 | Andrews | 91/488 |
| 3,793,923 | 2/1974 | Smith | 91/488 |
| 4,244,279 | 1/1981 | Stewart et al. | 91/488 |
| 4,261,250 | 4/1981 | Ohrberg | 91/491 |
| 4,263,814 | 4/1981 | Takaoka | 74/60 |
| 4,268,225 | 5/1981 | Nakayama | 417/269 |
| 4,285,640 | 8/1981 | Makai | 417/269 |
| 4,329,913 | 5/1982 | Nakayama | 92/71 |
| 4,347,046 | 8/1982 | Brucken | 417/269 |
| 4,420,986 | 12/1983 | Nakayama | 74/60 |

FOREIGN PATENT DOCUMENTS

| | | | |
|---|---|---|---|
| 980939 | 5/1951 | France | 417/269 |
| 146070 | 9/1982 | Japan | 74/60 |
| 983310 | 2/1965 | United Kingdom | 91/488 |

*Primary Examiner*—Carlton R. Croyle
*Assistant Examiner*—Paul F. Neils
*Attorney, Agent, or Firm*—Berman, Aisenberg & Platt

[57] ABSTRACT

A swash plate type compressor having shoes provided with center holes on the slidable surfaces. The center hole provided with a bottom acts as a reservoir for lubricating oil and supplys the oil on the slidable surface of the shoe, which slides against the swash plate. There can be a second ring groove concentric to the center hole, or annexed grooves which are stretching outward radially from the center hole. The center hole also prevents the center part from protruding outward by thermal expansion, which is caused by friction. The slidable surface of the shoe is preferably coated with a layer containing solid lubricant so as to smooth the sliding motions.

5 Claims, 8 Drawing Figures

SWASH PLATE TYPE COMPRESSOR HAVING A CENTER CAVITY IN SURFACE OF PISTON SHOE

This is a continuation of application Ser. No. 630,587, filed July 10, 1984, and now abandoned.

BACKGROUND OF THE INVENTION

1. Field of the Invention

The present invention relates to a swash plate type compressor, especially to the improvement of a shoe to be used in the compressor.

2. Description of the Prior Art

Conventionally, a swash plate type compressor is used in such system as an air conditioning system of an automobile. The swash plate type compressor comprises a cylinder block which includes plural cylinder bores parallel to a rotary shaft; a swash plate which is rotated by the shaft within the cylinder block; pistons which are movably disposed in the cylinder bores, and shoes disposed between the pistons and the sliding surface of the swash plate which reciprocates the pistons. In the operation of the compressor, the rotary shaft rotates the swash plate rockingwise and further reciprocates the pistons in the cylinder bores, thus compressing the refrigerant in the bores.

In such compressor, a heavy load and a high sliding speed are applied to the sliding surface of the shoes which slide against the surface of the swash plate. Therefore, when a lubricating oil is not sufficiently supplied to the sliding surfaces of the shoes, as often observed just at the start of the compressor operation, seizure is likely to occur on the sliding surfaces, especially on the central parts. The main reasons why seizure is likely to occur on the central part of the sliding surface are described in (A), (B) and (C) that follow.

(A) Conventionally, a lubricating oil is included in the refrigerant of the swash plate type compressor to be supplied between the sliding surfaces of the swash plate and the shoes for seizure prevention. Increase of the lubricating oil will smooth the sliding motions of the swash plate and the shoes, but will considerably lower the refrigerating capacity of an air-conditioning system, since the amount of the refrigerant to be sent to a heat exchange is reduced by the increase of the lubricating oil and the heat absorbing capacity of the refrigerant is impaired by the oil addition. Therefore, the less the lubricating oil added to the refrigerant, the more the refrigerating capacity. For this reason, it is preferred to reduced the amount of the lubricating oil, which results in increased tendency to cause seizure.

(B) During operation of the compressor, friction heats the shoes up to temperatures as high as 200° C. The heat generated in the shoes is dissipated from the peripheries of the shoes which are preferentially in contact with the refrigerant and the lubricating oil. Therefore, the heat is accumulated in the central parts of the shoes, which are likely to expand and protrude. Then, the protruded central parts are subjected to a higher load and are subject to seizure.

(C) During operation of the compressor, the film of the lubricating oil intervenes between the shoes and the swash plate and smoothes the sliding motions thereof. However, during stoppage of the compressor, lubricating oil forming the film flows down by gravity to produce an oil-less state in the interfaces between the swash plate and the shoes. Consequently, when the compressor is restarted after a long rest, the swash plate and the shoes slide against each other without any intervening oil film, and thus, seizure is likely to occur on the sliding surfaces of the shoes.

SUMMARY OF THE INVENTION

Accordingly, it is the object of the present invention to provide a novel swash plate type compressor with the improvement of seizure resistance.

The swash plate type compressor of the present invention is characterized by provision of a center hole with a bottom for accumulating on the center of the sliding surface of the shoe.

BRIEF DESCRIPTION OF THE DRAWINGS

FIG. 1(*b*) illustrates the sliding surface of the shoe shown in FIG. 1(*a*).

DETAILED DESCRIPTION OF THE INVENTION

Figure 1A:
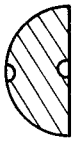
FIG. 1(*a*) is a sectional view of a typical shoe of the present invention.
Figure 1B:
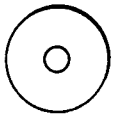

The shape of the shoe charactarizing the present invention may be a hemisphere, similar to conventional designs, a combination of a plane member and a ball or variation thereof. The following relates to the hemispheric shoes. FIG. 1(*a*) illustrates the cross section and FIG. 1(*b*) illustrates the sliding surface. As the figures illustrate, the hemispheric shoe has a spherical surface which slides against a piston, and an almost plane surface which slides against the sliding surface of the swash plate. The hemispheric shoes can be made by cutting a steel ball into hemispheres, or by forging a steel billet into a hemisphere.

The shoe, in which a plate and a ball are intergrated, is described as follows. The plane surface of the shoe slides against the swash plate, while the part slides against the concave spherical surface of the piston. The shoe of the present invention is provided with a center hole on the center of the sliding surface of this plane member. The shoe may be formed by forging, cutting or powder sintering.

The center hole of the shoe should exist on the center of the sliding surface of the shoe. And, the hole should provide a bottom, which is recessed from the sliding surface. On this viewpoint, the range of the hole can be selected to be in 0.2–10 mm, or preferably in 0.3–1.5 mm. Firstly, this center hole acts as a reservoir for oil. The size of the aperture of the hole is determined in consideration of such factors as the sliding area of the shoe and the applied load. Supply of oil to the sliding surface is easier with a larger aperture of the hole.

Secondly, the hole prevents the central part from protruding outward by thermal expansion, when the center of the shoe is excessively heated by friction. However, as the center hole has a larger aperture, the effective sliding surface becomes smaller and the applied load per unit area becomes larger. Accordingly, the ratio of the aperture area to the sliding surface should be commonly selected to be in a range of 0.3–20%, or should be preferably selected to be in a range of 1–20%.

Figure 2:
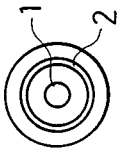
FIGS. 2 and 3 illustrate the sliding surfaces of other shoes.
Figure 3:
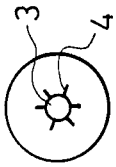

A large sliding surface pertinent to a large swash plate type compressor may have a second ring groove 2, concentric to the center hole 1, as shown in FIG. 2. Or, a center hole 3 may have annexed grooves 4, stretching outward radially from the hole, as shown in FIG. 3.

However, since the above-mentioned grooves reduce the effective sliding area, the grooves should be designed, in due consideration of the effect. The hole shape may be selected out of a nearly hemisphere, a cone, a circular truncated cone, a circular cylinder, a semiellipsoid, a trapezoid and so on.

The followings are the examples of the methods to form a center hole in a shoe.

(1) In forming a shoe by forging, a center hole can be simultaneously formed by using a die which has a projection matched to the hole.

(2) Or, after a shoe is forged, a press mold with a projection is pressed against the shoe to form a hole herein.

(3) A hole may also be formed by such cutting methods as drilling.

A shoe can be made of common structural materials such as metals and ceramics. Generally, a shoe is made of steel, such as bearing steel (Japanese Industrial Standard; SUJ2).

In order to improve the seizure resistance of the sliding surface of a shoe, the surface of preferably carbonitrided, carburized, quench hardened, boronized, nitrosulphurized or similarly treated.

Furthermore, the sliding surface of a shoe is preferably coated with a layer containing a solid lubricant. The layer may be a film of phenolic resin, unsaturated polyester or epoxy resin or the like filled with molybdenum disulfide, graphite, fluorocarbon resin or other lubricating powders. Also the layer may be a film of such soft metals as lead and bismuth.

The solid lubricant layer may cover the entire shoe surface of the sliding surface thereof alone.

The swash plate type compressor of the present invention is provided with a center hole on the sliding surface of the shoe, which slides against the swash plate subjected to the severest sliding condition. The center hole acts as a reservoir for lubricating oil. Accordingly, when the swash plate type compressor is operated under a limited supply of lubricating oil, a constant amount of lubricating oil is continuously supplied to the sliding surface of the shoe. Moreover, the center hole according to the present invention absorbs the thermal expansion of the shoe and prevents the sliding surface of the shoe from protruding, even when the swash plate type compressor is operated for a long time under severe condition and heat generated by friction is so concentrated on the center of the shoe that the sliding surface of the shoe may be expanded to protrude. Therefore, a large local load is hardly applied to the center of the shoe and thus, seizure is scarecely induced.

In addition, even when the compressor is left unoperated for a long time, a constant quantity of lubricating oil remains in the center hole on the sliding surface of the shoe, contrary to the conventional type compressors. Therefore, when the compressor is restarted, the lubricating oil in the center hole is instantly supplied to the sliding surfaces of the shoe and the swash plate. Accordingly, seizure of the sliding surfaces can be prevented at the start and the initial stage of operation. And also, this effect is accompanied with the decrease in the frictional resistance at the start of operation.

In contrast with the conventional swash plate type compressor, in which a number of holes are distributed on almost all the sliding surface of the shoe, the swash plate type compressor of the present invention, which has a center hole in the center of the sliding surface of the shoe, provides a smaller effective sliding area, which results in no substantial decrease of the seizure load.

From the above-mentioned effects, the swash plate type compressor of the present invention secures the supply of a certain amount of lubricating oil to the sliding surfaces of the swash plate and the shoe. And the troubles caused by seizure can be effectively prevented in both cases where the compressor is operated under severe conditions for a long time and where lubricating oil is not supplied from the outside of the shoe at the start of operation.

EXPERIMENTAL RESULTS

To prove the above-mentioned effects of the present invention, the inventors conducted experiments with five sorts of shoes which have various holes on the sliding surfaces.

Figure 4:
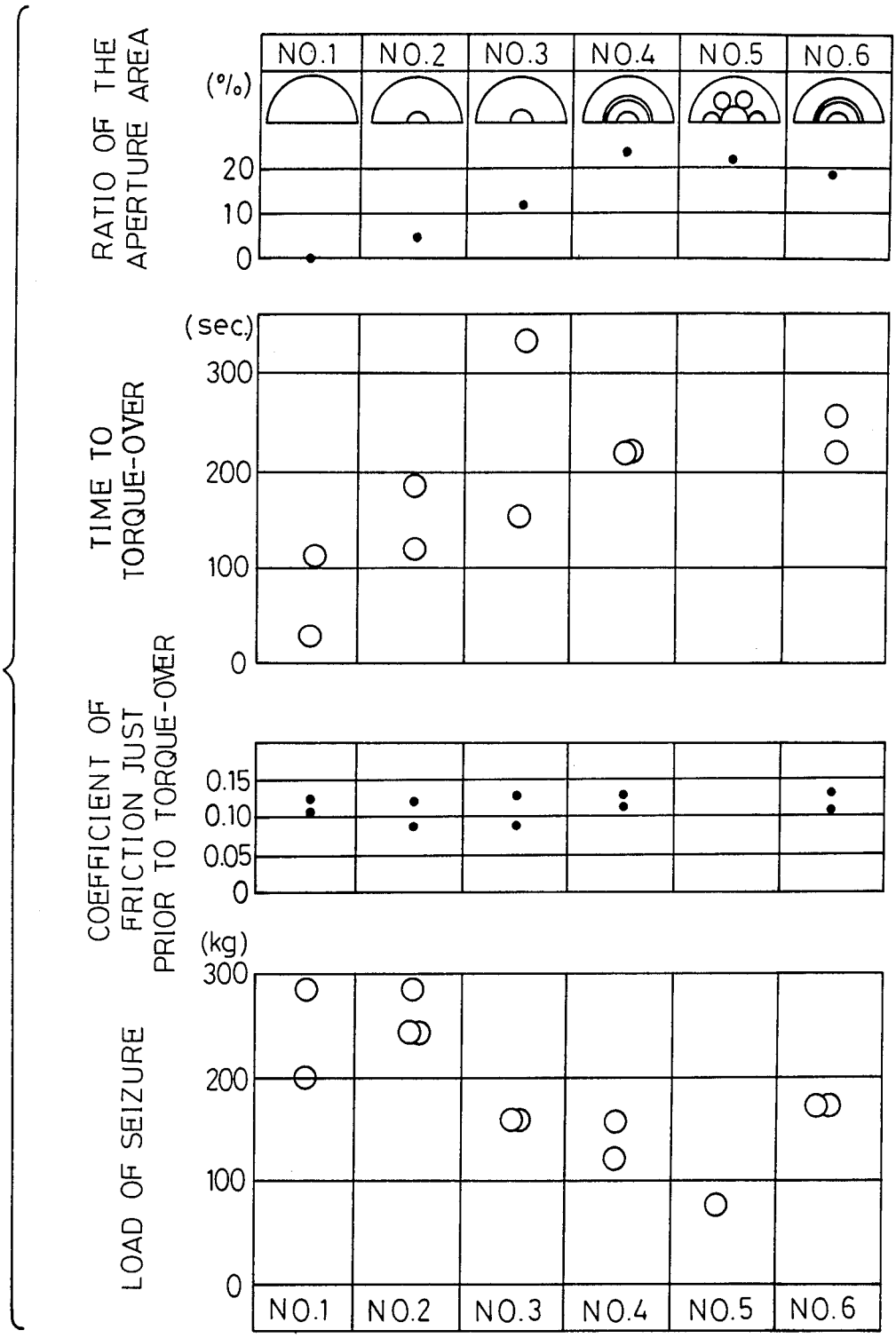
FIG. 4 is a diagram showing the times to torque-over and the loads of seizure for five sorts of shoes with different sliding surfaces.

The upper part of FIG. 4 illustrates the sliding surfaces of the five sorts of shoes experimented. Each of the shoes had a shape of a hemisphere of 13.5 mm in diameter. It was 12 mm in diameter of sliding surface. The material of the shoes was a bearing steel (SUJ2) with a hardness of Hv 380. No. 1 shoe had no hole on the sliding surface. No. 2 had a center hole of 2.5 mm in diameter and 1.0 mm in depth on the center of the sliding surface. No. 3 shoe had a center hole of 4 mm in diameter and 2.0 mm in depth on the center of the sliding surface. No. 4 shoe had a center hole of 2.5 mm in diameter and 0.8 mm in depth, and a concentric ring groove around the center hole. No. 5 shoe had a center hole of 2.5 mm in diameter and 1.0 mm in depth, and six holes of 2.0 mm in diameter and 1.0 mmm in depth around the center hole. No. 6 shoe had a center hole of 2.5 mm in diameter and 0.8 mm in depth, and a concentric ring groove of 6.5 mm in inner diameter and 8.0 mm in outer diameter, which groove around the center hole.

In the first experiment, measurement was made of the torque-over time, the time until a predetermined torque became necessary for sliding the mating surface. The experiment was carried out under a load of 12 kg and a sliding speed of 5 m/sec.. The used lubricating oil was a mixture of one part of refrigerator oil and nine parts of light oil. After one drop of the lubricating oil was supplied on the shoe before operation, the sliding experiment was carried out without further oil supply and the time was measured until the shoe seized and the torque-over was observed. FIG. 4 indicates the results of the experiments. FIG. 4 also shows the area ratio of the holes to the sliding surface of each shoe, and the coefficient of friction just prior to the torque-over. As shown in FIG. 4, the time of the torque-over was longer in each of Nos. 2–4, 6 shoes than in No. 1 shoe. No. 5 shoe was not tested for the torque-over time because the seizure load was so low as shown below.

In the second experiment, the load of seizure was examined. At a constant sliding speed of 15 m/sec., the load was increased by an increment of 40 kg., and the minimum load was measured when seizure occured. The disk opposite to the shoe was made of Al-Si alloy, Al18Si-4.5 Cu. The same lubricating oil as the one used in the first experiment was continuously supplied to the disk surface. The result of this experiment is also shown in FIG. 4. The seizure load of No. 2 shoe was 240-290 kg, which was a good result. The seizure loads of Nos. 3-6 shoes were, however, smaller than that of No. 1. Especially, the seizure load of No. 5 shoe with a number of holes was 80 kg, less than half the loads of other shoes. These results suggest that there is a certain limit in the ratio of the hole area to the sliding surface area, a bore which the load of seizure considerably decreases. The experiment also clarified that a multiple of distributed holes shoud be avoided.

The third experiment was made to examine the effects of solid lubricant layers. The inventors measured the torque-over time in accordance with the above-mentioned method for four sorts of shoes prepared as described below. Each shoe used was a hemisphere of 13.5 mm in diameter, made of a bearing steel (SUJ-2), hardened to a hardness of Hv 760. And a center hole of 2.5 mm in diameter was provided on the bottom of the shoe. The sliding surfaces of the shoes were surface treated except No. 7 shoe. No. 8 shoe was covered with a resin film filled with Molybdenum disulfide powders. No. 9 shoe was treated by salt bath nitriding to form a soft nitride layer on the sliding surface. No. 10 shoe was treated by salt bath nitriding in the same way as for No. 9 shoe coated with a resin film filled with Molybdenum disulfide powders. The results of this experiment are shown in FIG. 5.

Figure 5:
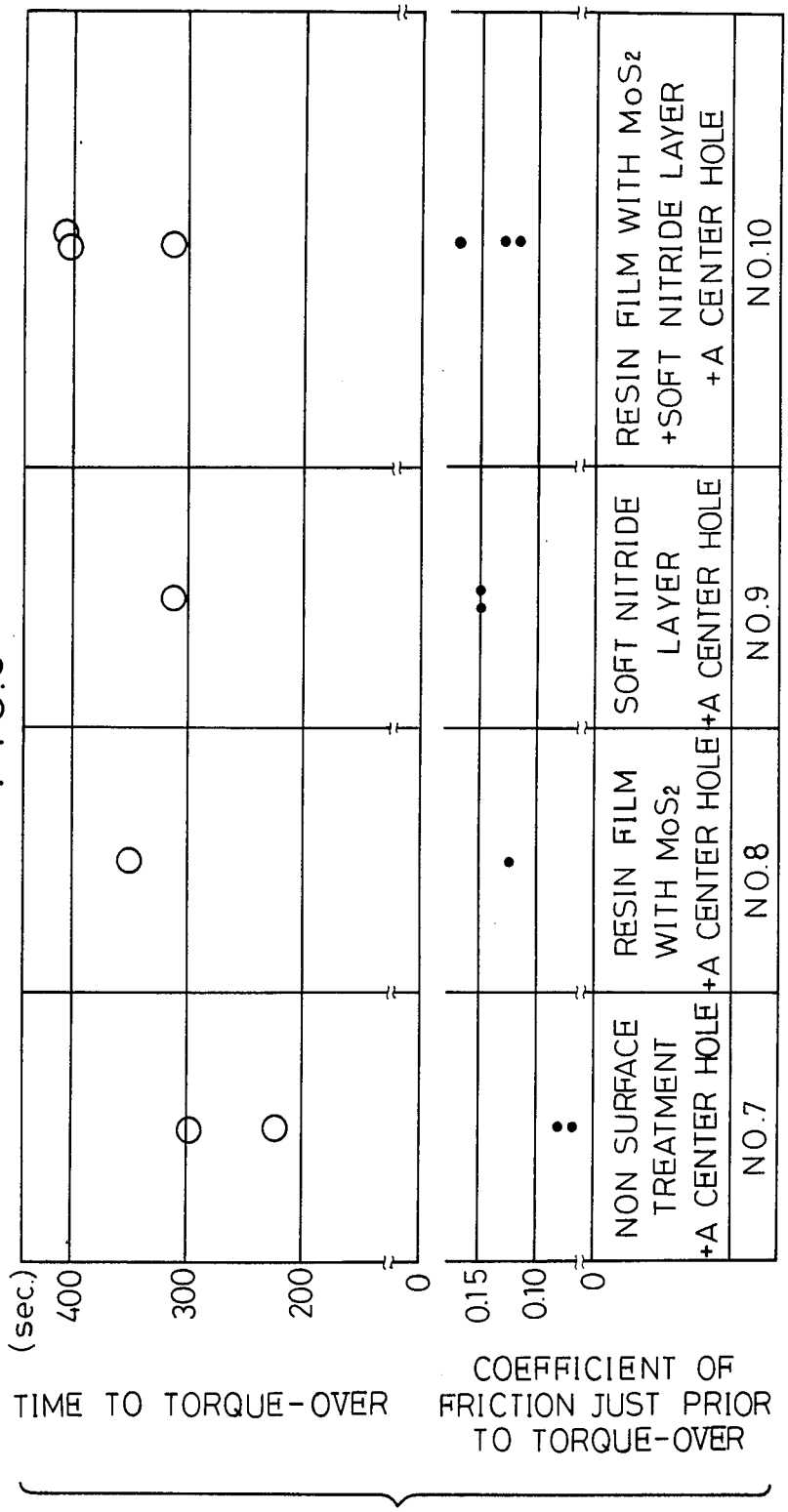
FIG. 5 is a diagram showing the times to torque-over for shoe whose sliding surfaces have almost the same shape as No. 2 shoe but are coated with different solid lubricant layers.

The time to torque-over was longer in each of Nos. 8-10 shoes which were surface treated than that in No. 7 shoe which was untreated, as shown in FIG. 5. In particular, a remarkable good result was obtained of No. 10 shoe, which had a center hole and was nitrided in a salt bath, subsequently coated with a film containing molybdenum disulfide powders.

EMBODIMENT

Figure 6:
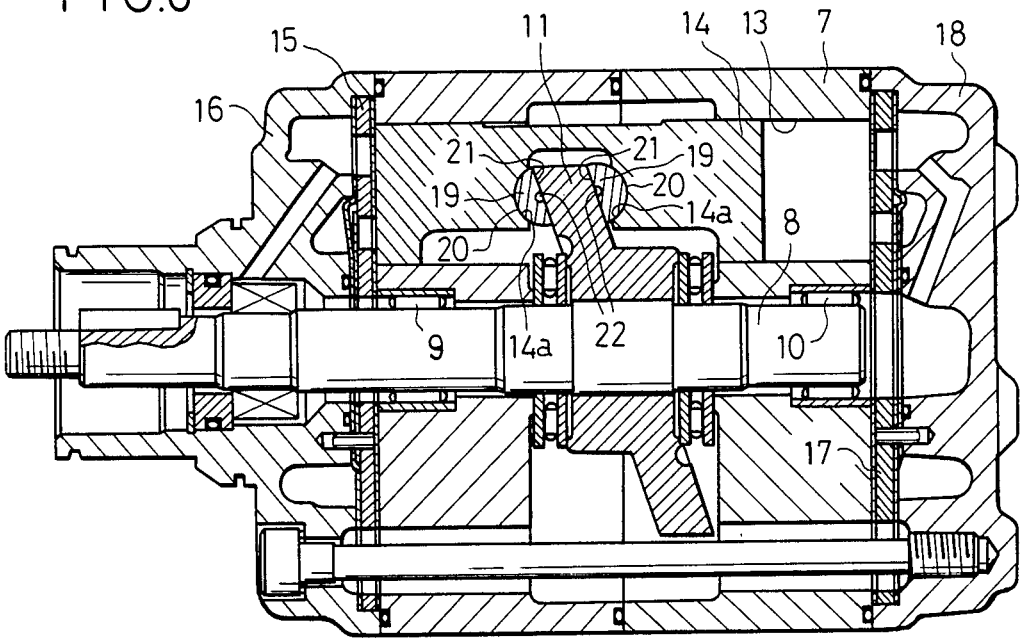
FIG. 6 is a sectional view of the swash plate type compressor in the embodiment of the present invention.

FIG. 6 illustrates a sectional view of a swash plate type compressor of the embodiment of the present invention. In a cylinder block 7, a rotary shaft 8 is rotatably supported by means of bearings 9, 10. And, a swash plate 11 is fixed to the rotary shaft 8. The cylinder block 7 has plural cylinder bores 13, into each bore 13, of which a piston 14 is slidably set. The left opening of the cylinder block 7 is closed with a valve plate 15 and a front cylinder head 16, while the right opening of the cylinder block 7 is closed with a valve plate 17 and a rear cylinder head 18. A spherical hollow part 14*a* is formed on the center of the aforesaid piston 14. A hemispheric shoe 19 has a spherical surface 20 which slides against a spherical concavity 14*a* of the piston 14 and a plane sliding surface 21 with a center hole 22 which slides against the sliding surface of the swash plate 11. The shoe 19 is made of bearing steel, and has a sliding surface of 10 mm in diameter and a center hole of 2.5 mm in diameter 1 mm in depth. The shoe surface is coated with a MoS containing resin film. On the other hand, the swash plate is made of Al-Si alloy. The constitution of this embodiment is fundamentaly the same as that of the conventional swash plate type compressor.

In order to test the performance of practical models of this swash plate type compressor, a hydraulic compression test was made of five swash plate type compressors which were made in accordance with the above-mentioned embodiment. All the five swash plate type compressors had no trouble such as seizure and passed the cycle test described above.

Figure 7:
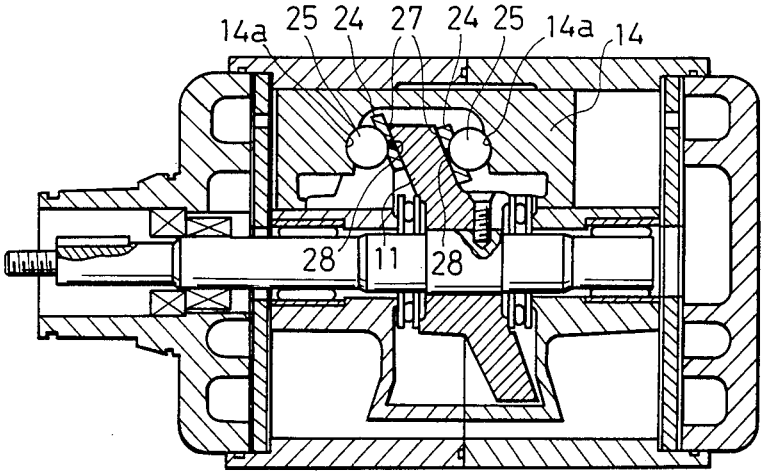
FIG. 7 is a sectional view of the swash plate type compressor with plate type shoes.

Although the shoe may be a hemispheric shoe such as that in the above-mentioned embodiment of the swash plate type compressor, a combination of a plate shoe 24 with a ball 25 (shown in FIG. 7) may also be used. The following explains a swash plate type compressor with a plate shoe and a ball. The plate shoe 24 slides against the swash plate 11. A ball 25 is provided between a spherical concavity 14*a* of a piston 14 and a spherical concavity of the shoe 24. A center hole 28 for oil reserving is provided on the center of the sliding surface 27 of the shoe 24, in the same way as in the above-mentioned embodiment.

What is claimed is:

1. A swash plate type compressor comprising a cylinder block which has at least one cylinder bore which extends parallel to a rotatable shaft;

a swash plate rotated by said rotatable shaft within said cylinder block and having a sliding surface transverse to said rotatable shaft;

a piston attached movably within said cylinder bore; and a shoe which intervenes between said piston and said swash plate and reciprocates said piston by rotation of said swash plate, wherein said shoe has a substantially non-deformable surface which contacts said sliding surface of said swash plate, said substantially non-deformable surface being provided with a cavity which forms an opening to said shoe and which terminates within said shoe, the area of said opening being from 0.3% to 20% of the area of said surface of said shoe.

2. A swash plate type compressor as claimed in claim 1, wherein said shoe is hemispheric and is provided with a spherical surface to be in contact with said piston and a plane surface to be in contact with said sliding surface of said swash plate.

3. A swash plate type compressor as claimed in claim 1, wherein said shoe comprises a plate member which slides against said sliding surface of said swash plate and a ball which intervenes between said plane member and said piston.

4. A swash plate type compressor as claimed in claim 1, wherein a layer containing solid lubricant is formed on the sliding surface of said shoe, which slides against said sliding surface of said swash plate.

5. A swash plate type compressor as claimed in claim 1, wherein said shoe has at least one ring groove around said cavity to form an oil reserve on the sliding surface thereof.

* * * * *